United States Patent [19]

Weenink

[11] Patent Number: 4,943,898

[45] Date of Patent: Jul. 24, 1990

[54] ELECTRIC LAMP HAVING A LAMP CAP OF SYNTHETIC MATERIAL

[75] Inventor: Leon P. Weenink, Eindhoven, Netherlands

[73] Assignee: U.S. Philips Corporation, New York, N.Y.

[21] Appl. No.: 263,100

[22] Filed: Oct. 26, 1988

[30] Foreign Application Priority Data

Nov. 20, 1987 [NL] Netherlands ..... 8702780

[51] Int. Cl.[5] ..... H01R 33/00

[52] U.S. Cl. ..... 362/226; 439/57; 439/547

[58] Field of Search ..... 362/226, 457; 439/56, 439/57, 58, 541, 546, 547

[56] References Cited

U.S. PATENT DOCUMENTS

| | | | |
|---|---|---|---|
| 3,050,705 | 8/1962 | Benson | 439/57 |
| 3,511,982 | 4/1967 | Salter | 362/382 |
| 3,859,554 | 1/1975 | Preziosi et al. | 439/57 |
| 4,152,622 | 5/1979 | Fitzgerald | 439/56 |
| 4,193,653 | 3/1980 | Aizawa | 439/57 |
| 4,299,430 | 11/1981 | Baba et al. | 439/57 |
| 4,468,585 | 8/1984 | Beyland et al. | 439/57 |
| 4,516,824 | 5/1985 | Winogrocki et al. | 439/547 |

FOREIGN PATENT DOCUMENTS 2547089 12/1984 France .

*Primary Examiner*—Ira S. Lazarus
*Assistant Examiner*—Richard R. Cole
*Attorney, Agent, or Firm*—Brian J. Wieghaus

[57] ABSTRACT

The electric lamp has a lamp vessel received by an opening in a lamp cap of synthetic material. The lamp cap has a first set of projections with contact surfaces, over which current conductors extend, and a second set of projections with contact surfaces. The first projections are elongate cantilevered tongues, which extend at a certain distance along the circumference of the lamp cap and have their contact surfaces at their free ends. The lamp is suitable to be used in a printed circuit board with wide tolerances with respect to its thickness.

9 Claims, 1 Drawing Sheet

ELECTRIC LAMP HAVING A LAMP CAP OF SYNTHETIC MATERIAL

BACKGROUND OF THE INVENTION

The invention relates to an electric lamp having a lamp cap of synthetic material for use in a printed circuit board. The lamp comprises a tubular translucent lamp vessel, an electric element in the lamp vessel and, current conductors extending from the electric element through a first end of the lamp vessel to the exterior.

A lamp cap of synthetic material having a longitudinal axis is connected to the lamp vessels the lamp cap comprises a sleeve-shaped portion having an opening for receiving the lamp vessel and, a first set of outwardly directed projections at the sleeve-shaped portion each with a first contact surface and a second set of outwardly directed projections each with a second contact surface.

The second contact surfaces face the first contact surface and lie in the direction of the longitudinal axis at a certain distance therefrom.

The first end of the lamp vessel is received by the opening of the lamp cap and the current conductors extending over a respective contact surface of a set of projections. Such a lamp is known from DE No. 1589314 A1 to which U.S. Pat. No. 3,511,982 corresponds.

A disadvantage of the known lamp is that the current conductors of the lamp are themselves the contacts which have to establish an electrical connection with tracks of a printed circuit board. The current conductors are generally fairly thin and slack so that they have little resilience. This results in that stringent requirements have to be imposed on the thickness of a board and of the printed circuit thereon, so that a good contact is guaranteed between the current conductors and tracks of the said printed circuit when the lamp is arranged in a printed circuit board. These stringent requirements cause a printed circuit board to be expensive.

A possibility of preventing the necessity of these stringent requirements is to provide the lamp cap with metal springs, which on the one hand are in contact with the current conductors and on the other hand can establish in a reliable manner contact with tracks of a printed circuit. However, this possibility is expensive because a larger number of parts to be assembled are required for the lamp.

SUMMARY OF THE INVENTION

The invention has for its object to provide an electric lamp of the kind mentioned in the opening paragraph, which has a simple construction and nevertheless is capable of establishing reliable contacts with tracks of a printed circuit with tolerances with respect to the thickness of the board carrying the printed circuit and with respect to the thickness of the tracks.

This object is achieved in an electric lamp of the kind mentioned in the opening paragraph in that the projections of the first set are cantilevered tongues which extend at a certain distance from the sleeve-shaped part along its circumference and have the first contact surface at their free ends.

Due to their shape, the first projections are resilient. The current conductors are consequently brought into reliable contact and held in reliable contact with tracks of a printed circuit board, for which the lamp is intended, in spite of tolerances with respect to the thickness thereof.

It is particularly favorable if the current conductors extend over a respective first contact surface, but they may alternatively extend over a second contact surface.

In a favorable embodiment, the contact surfaces over which the current conductors extend have a securing means for these conductors, for example a groove, by which the relevant conductor is received, or openings through which the conductor extends. The conductor may also be bent around the free end of the projection, e.g. of the tongue, for additional fixing.

The synthetic material of the lamp cap may be, for example, a thermoplast, for example a polyether imide or a polyether sulphone that may be filled with, for example, powder or fibres, such as glass powder or glass fibres.

The electric element in the lamp vessel may be a filament, but may alternatively be a pair of electrodes.

BRIEF DESCRIPTION OF THE DRAWINGS

An embodiment of the electric lamp according to the invention is shown in the drawing. In the drawing.

DETAILED DESCRIPTION OF THE PREFERRED EMBODIMENTS

Figure 1:
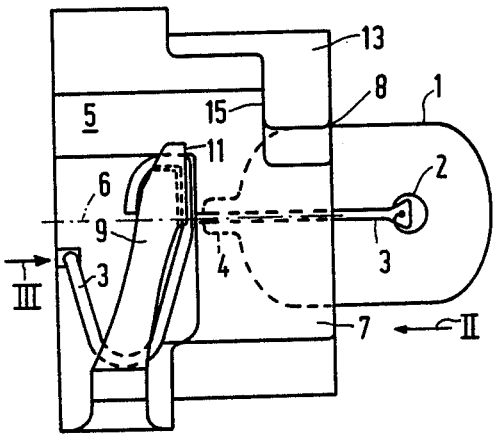
FIG. 1 is a side elevation of an electric lamp having a lamp cap of synthetic material.

The electric lamp having a lamp cap of synthetic material shown in FIG. 1 is suitable for use in a printed circuit board. The lamp has a tubular translucent lamp vessel 1, in which an electric element 2, i.e. a filament, is arranged. Current supply conductors 3 extend from the electric element 2 through a first end 4 of the lamp vessel 1 to the exterior. A lamp cap 5 of synthetic material has a longitudinal axis 6 and a sleeve-shaped portion 7 provided with an opening 8 for receiving the lamp vessel 1. At the sleeve-shaped portion 7 (cf. also FIGS. 2 and 3) is formed a first set of projections 9, 10 extending laterally outwards with each a first contact surface 11 and 12, respectively, and a second set of projections 13, 14 extending laterally outwards with each a second contact surface 15 and 16, respectively. The second contact surfaces 15, 16 are directed towards the first contact surfaces 11, 12 and are arranged in the direction of the longitudinal axis 6 at a certain distance therefrom.

The first end 4 of the lamp vessel 1 is received by the opening 8 of the lamp cap 5 and the current conductors 3 extend over a respective contact surface 11, 12.

The projections 9, 10 of the first set are elongate cantilevered tongues, which extend at a certain distance from the sleeve-shaped part 7 along its circumference and have at their free ends the first contact surface 11 and 12, respectively.

The embodiment shown is suitable to be inserted, the lamp vessel 1 direct forwards, through an opening intended for this purpose in a printed circuit board and then to be rotated in the direction of the arrow P (cf.

Figure 3:
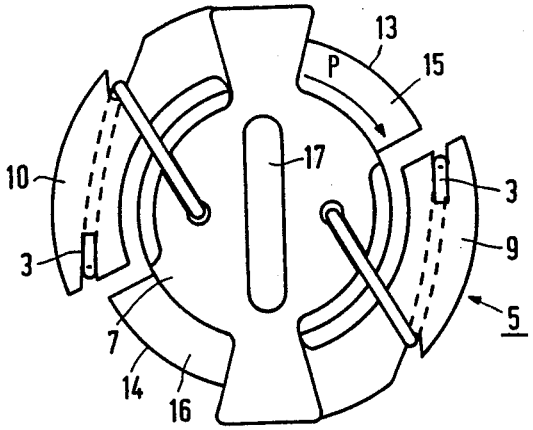
FIG. 3 is a rear view of the lamp cap shown in FIG. 1.

FIG. 3). For this purpose, a slot 17 for a screw-driver is provided. The second contact surfaces 15, 16 are then located on one side and the first contact surfaces 11, 12 are located on the other side against the board. The distance in the axial direction between the second contact surfaces 15, 16 and the current conductors 3 on the first contact surfaces 11, 12 is chosen so that this distance is at most equal to the smallest thickness that a printed circuit board for which the electric lamp is intended together with a track thereon can have. If the board with a track on it has a thickness larger than the minimum permissible thickness, the lamp can nevertheless be arranged due to the fact that the projections of the first set are then bent away in axial direction. Whilst maintaining good electrical contacts, the electric lamp according to the invention permits a wide tolerance with respect to the thickness of the printed circuit board. In a modification of the electric lamp of FIG. 1, in which the opening 8 receiving the end 4 of the lamp vessel 1 is located on the lefthand side of FIG. 1, the lamp can be inserted, the lamp cap 5 directed forwards, into the same printed circuit board.

Figure 2:
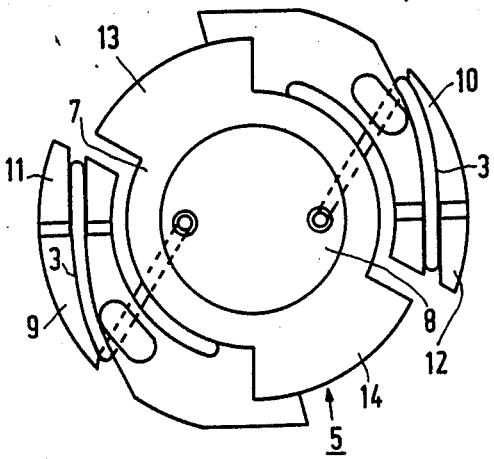
FIG. 2 is a front elevation of the lamp cap shown in FIG. 1.

FIGS. 2 and 3 show clearly the shape of a tongue of the projections 9, 10 of the first set and their course along the circumference of the sleeve-shaped portion 7 at a certain distance and so as to be free therefrom. As a result, the projections 9, 10 have a high resilience and the lamp cap 5 consequently has a high adaptability to the thickness of a board.

Due to the fact that the contact surfaces 11, 12 have a smaller axial distance from the second contact surfaces 15, 16 than other portions of the projections 9, 10 of the first set, they retain their function as contact surfaces, i.e. regions in which contact is established by the lamp cap 5 with a board, if a comparatively thick board gives rise to displacement of these surfaces in the axial direction.

The first contact surfaces 11, 12 have a securing means for the current conductors 3 in the form of a groove 18 and 19, respectively, of small depth, i.e. smaller than the thickness of the current conductors 3, by which these current conductors are received. For additional fixing, the current conductors 3 are bent around the free end of the projections 9, 10.

What is claimed is:

1. An electric lamp assembly, comprising:

an electric lamp, said electric lamp comprising a translucent lamp vessel, an electric element disposed in the lamp vessel, and current conductors extending from the electric element through a first end of the lamp vessel to the exterior; and a lamp cap of synthetic material, said lamp cap comprising a sleeve-shaped portion defining a longitudinal axis and having an opening for receiving said first end of said lamp vessel, a pair of elongate cantilevered tongues, said tongues extending freely in the circumferential and longitudinal direction of said sleeve-shaped portion, each tongue having a first contact surface resiliently displaceable in the longitudinal direction, and a pair of projections extending from said sleeve-shaped portion each with a second contact surface transverse to the longitudinal axis, said second contact surfaces facing said first contact surfaces and being longitudinally spaced at a predetermined distance therefrom, the first end of the lamp vessel being secured in said lamp cap opening and the current conductors extending over a respective one of said first contact surfaces or said second contact surfaces.

2. An electric lamp as claimed in claim 1, wherein the current conductors extend over a respective first contact surface.

3. A electric lamp as claimed in claim 2, wherein each contact surface over which a current conductor extends comprises securing means for securing the current conductor on the respective contact surface.

4. An electric lamp as claimed in claim 3, wherein said securing means comprises a groove.

5. An electric lamp as claimed in claim 1, wherein each contact surface over which a current conductor extends comprises securing means for securing the current conductor on the respective contact surface.

6. An electric lamp as claimed in claim 5, wherein said securing means comprises a groove.

7. An electric lamp assembly, suitable for use on a circuit board having conductive paths, said lamp assembly comprising:

an electric lamp, said lamp comprising a translucent lamp vessel, an electric element disposed in the lamp vessel, and current conductors extending from the electric element through a first end of the lamp vessel to the exterior; and a lamp cap of synthetic material adapted for securing within an aperture within a circuit board, said lamp cap comprising a sleeve-shaped portion defining a longitudinal axis and having an opening for receiving said first end of said lamp vessel, a pair of projections extending radially outward from said sleeve-shaped portion near its end having said opening, each projection having a transverse surface facing in the axial direction away from said opening, and a pair of elongate cantilevered tongues, each tongue extending from said sleeve-shaped portion and having a resilient portion extending freely in the circumferential direction of said sleeve-shaped portion and axially towards said projections, said tongues terminating at respective transverse contact surfaces which face said transverse surfaces of said projections, said contact surfaces being resiliently displaceable away from said projections, and said first end of said lamp vessel being secured in said lamp cap opening and said current conductors extending over a respective said contact surface, and said contact surfaces being longitudinally spaced from said projections a predetermined distance such that when assembled on a circuit board said contact surfaces are resiliently biased against said circuit board for securing said lamp assembly to the circuit board and said current conductors are resiliently biased against respective conductive paths located on the circuit board.

8. An electric lamp as claimed in claim 7, wherein each contact surface comprises securing means for securing the current conductor on the respective contact surface.

9. An electric lamp as claimed in claim 8, wherein said securing means comprises a groove.

* * * * *